US005743313A

United States Patent [19]

Josefsson

[11] Patent Number: 5,743,313

[45] Date of Patent: Apr. 28, 1998

[54] APPARATUS AND METHOD FOR EMPTYING A CONTAINER IN AN ASEPTIC MANNER

[75] Inventor: Lars Josefsson, Libertyville, Ill.

[73] Assignee: Tetra Laval Holdings & Finance S.A., Pully, Switzerland

[21] Appl. No.: 629,830

[22] Filed: Apr. 10, 1996

[51] Int. Cl.[6] ..... B65B 1/04

[52] U.S. Cl. ..... 141/330; 141/85; 141/90; 141/114; 414/412

[58] Field of Search ..... 141/2, 19, 85, 141/89, 91, 114, 329, 330, 346, 363, 364, 365, 369, 375, 379, 385, 386; 222/81, 83, 83.5; 414/412

[56] References Cited

U.S. PATENT DOCUMENTS

| | | | |
|---|---|---|---|
| 2,876,026 | 3/1959 | Mancini . | |
| 4,527,716 | 7/1985 | Haas et al. | 222/83.5 |
| 5,117,875 | 6/1992 | Marrucchi . | |
| 5,117,876 | 6/1992 | Kuntz . | |
| 5,141,133 | 8/1992 | Ninomiya | 222/81 |
| 5,373,872 | 12/1994 | Mueller | 141/85 |
| 5,405,053 | 4/1995 | Zublin | 141/330 |
| 5,467,806 | 11/1995 | Stricklin et al. | 141/346 |

OTHER PUBLICATIONS

Tetra StarAsept—The Aseptic Bulk Packaging System, describing a system on sale on or before Apr. 10, 1995.

*Primary Examiner*—Renee S. Luebke
*Assistant Examiner*—Steven O. Douglas
*Attorney, Agent, or Firm*—McAndrews, Held & Malloy, Ltd.; Michael A. Catania

[57] ABSTRACT

An apparatus and method are used for emptying a container in a hygienic (preferably aseptic), for example, aseptic manner. In one embodiment, the device comprises a housing having a first aperture that opens to a first internal chamber and a second aperture that opens to a second internal chamber. The second internal chamber is generally hygienic and opens to a hygienic storage tank or the like at the second aperture. A sealing member is disposed about the first aperture for sealing the container to be emptied over the first aperture. A sterilizing apparatus is provided for rendering the first internal chamber generally hygienic when the container has been sealed over the first aperture. A chamber separating mechanism is utilized to selectively provide fluid communication between, the first and second internal chambers. A cutting member is operable to cut the container in the area of the first aperture to thereby allow the container to be emptied into the first internal chamber.

25 Claims, 14 Drawing Sheets

Fig. 10
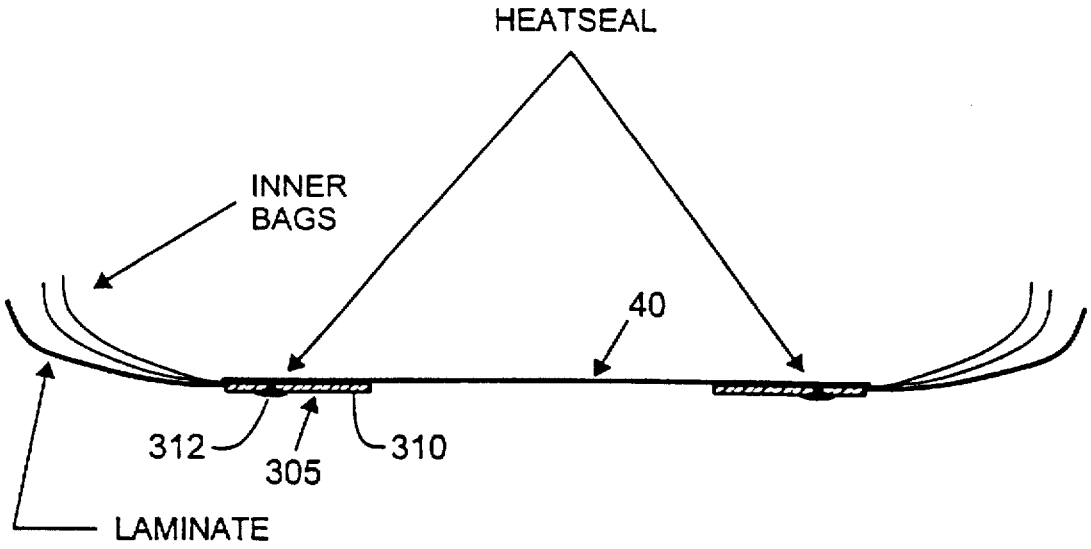
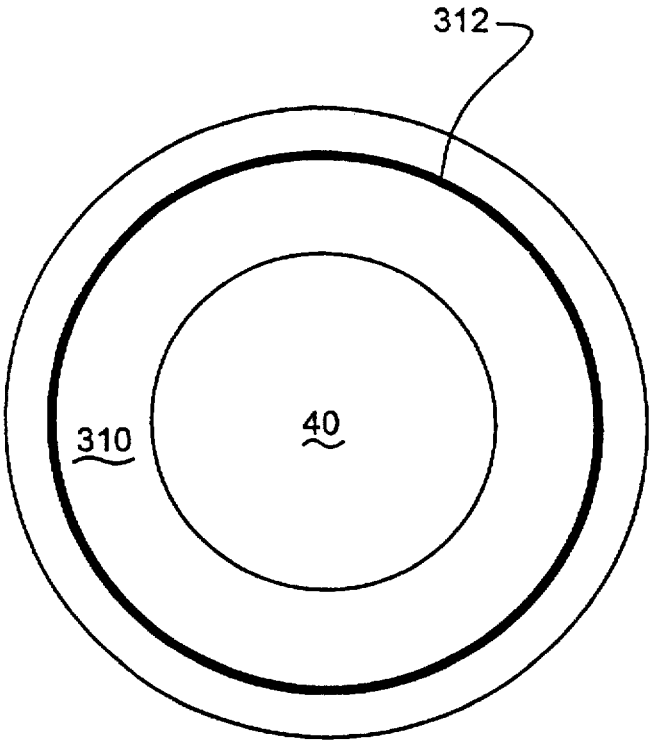
Fig. 9

APPARATUS AND METHOD FOR EMPTYING A CONTAINER IN AN ASEPTIC MANNER

FIELD OF THE INVENTION

The present invention relates generally to the emptying of a container in a hygienic (preferably aseptic) manner. More particularly, the present invention relates to an apparatus and method for aseptically emptying a container holding processed food products or the like for subsequent processing and/or packaging.

BACKGROUND OF THE INVENTION

Fresh food products, such as recently harvested fruits and vegetables (e.g., crushed pineapple and tomato tidbits), are often shipped in bulk in high volume aseptic containers (e.g., flexible bags) to food packaging and/or processing plants. Typical volumes for such containers span between 6 and 300 U.S. gallons. Once these containers arrive at the plants, they are opened so that the food product may be emptied directly into a packaging and/or processing machine, or, for example, into an intermediate storage tank.

Because the food products contained in the package have already been treated so as to be free of pathogens, it is desirable to empty the food products from the packaging in a manner that maintains the aseptic integrity of the food content. If the aseptic integrity of the food content is maintained, the food content does not have to undergo a further sterilization treatment (e.g., pasteurization) prior to the further processing and/or packaging of the food product. Several advantages naturally flow from the elimination of the need for further sterilization. First, the quality of the food product is enhanced since the added sterilization process often degrades food quality. The loss of product quality from further sterilization treatment is particularly problematic in the case of, for example, diced tomatoes, which may take on a "mash" texture upon heat treatment. Second, when the further sterilization step is eliminated, the equipment, time, and energy costs associated with the further sterilization step are likewise eliminated. Third, the product losses typically inherent in the further sterilization step are eliminated thereby providing a more efficient packaging/processing throughput. For example, pumps and other processes associated with further heat treatment often have limitations that subject the food products to further damage.

Currently, one way of emptying aseptic packaging bags is to cut the bags with a knife and pour the product into a storage tank under the force of gravity. In this process, however, the food products are exposed to non-sterile conditions. Consequently, the food products are contaminated and must be subject to a second sterilization treatment before final packaging. As noted above, this process suffers from several disadvantages including the additional costs and product degradation and losses associated with a second sterilization treatment.

Several different aseptic packaging and transfer systems are available for use in emptying food products or the like from high volume flexible bags. Each such system utilizes flexible bags having specifically designed spouts formed therein. One known packaging bag, sold by Tetra Pak, Inc., of Chicago, Ill., utilizes a patented spout (U.S. Pat. No. 4,731,978) that is affixed to the bag to allow for aseptic filling and emptying of the bag with specifically designed filling and unloading equipment. The Tetra-Pak prefabricated spout opens to the inside of the flexible bag, thereby allowing the bag to be opened to an aseptic environment.

The ability to empty such bags in an aseptic manner is limited to bags having such prefabricated spout. Consequently, there remains a problem with respect to the emptying of packaging bags that lack a prefabricated spout, in an aseptic manner.

SUMMARY OF THE INVENTION

An apparatus and method are disclosed for emptying a container in a hygienic, for example, aseptic manner. In one embodiment, the device comprises a housing having a first aperture that opens to a first internal chamber and a second aperture that opens to a second internal chamber. The second internal chamber is generally hygienic (preferably aseptic) and, for example, opens to a hygienic (preferably aseptic) storage tank or the like at the second aperture. A sealing member is disposed about the first aperture for sealing the container to be emptied over the first aperture. A sterilizing apparatus is provided for rendering the first internal chamber generally hygienic (preferably aseptic) when the container has been sealed over the first aperture. A chamber separating mechanism is utilized to selectively provide fluid communication between the first and second internal chambers. The chamber separating apparatus is operable to seal the first internal chamber from the second internal chamber when the first internal chamber is exposed to a non-hygienic environment, and, further, is operable to allow fluid communication between the first and second internal chambers after the first internal chamber has been rendered generally hygienic (preferably aseptic) by the sterilizing means. A cutting member is also provided. The cutting member is operable to cut the container in the area of the first aperture to thereby allow the container to be emptied into the first internal chamber. Once the container is opened, the chamber separating mechanism is actuated to allow the product content of the container the flow into the second chamber and, therefrom, through the second aperture to the desired destination.

In accordance with one embodiment of the apparatus, the chamber separating mechanism comprises a piston that is movable between a first position in which it defines and seals the first internal chamber and a second position in which the first and second internal chambers are placed in fluid communication. The piston may be moved between the first and second positions either manually, or by linear actuators.

Various mechanisms are contemplated for securing the container to the sealing member. For example, a vacuum system may be provided to generate an underpressure to the sealing member to secure the container thereto. Alternatively, or in addition, an interlocking mechanism may be provided which comprises a first interlocking part that is secured to the container and a second interlocking part that is associated with the housing. The first interlocking part, for example, may be a flange, while the second interlocking part, for example, may be an arm having a locking finger. The arm may be moved between a first position in which it is generally disengaged from the flange and a second position in which it engages the flange to secure the container over the first aperture.

Other objects and advantages of the present invention will become apparent upon reading the following detailed description and appended claims, and upon reference to the accompanying drawings.

BRIEF DESCRIPTION OF THE DRAWINGS

FIG. 9 is a top view of a plastic ring member that may be disposed on a bag to be emptied in accordance with another embodiment of the apparatus and method.

FIG. 10 is a cross-sectional view of the plastic ring member of FIG. 9 affixed to a bag to be emptied.

DETAILED DESCRIPTION OF THE PREFERRED EMBODIMENT

Figures 1A, 1B, 1C:
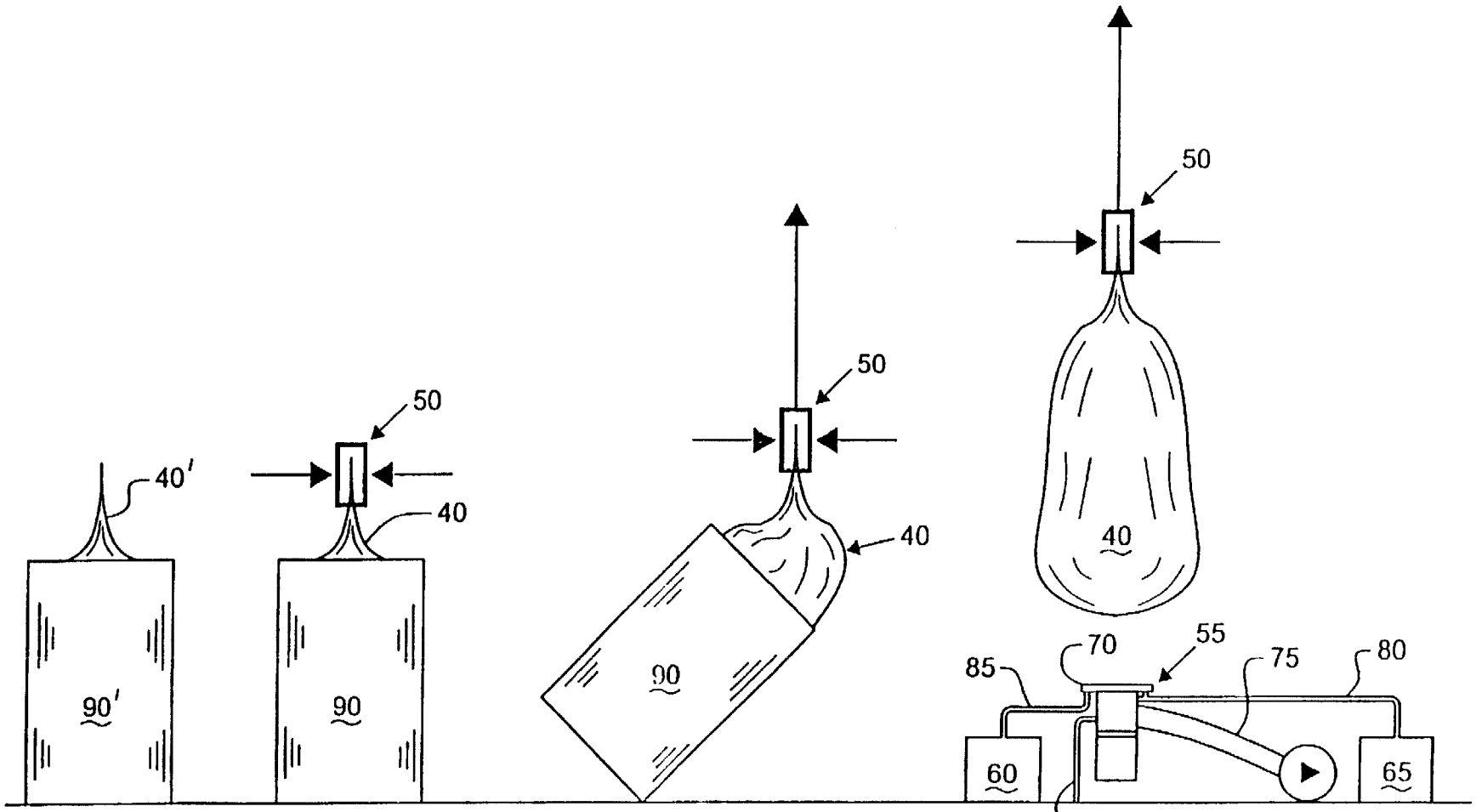
FIGS. 1*a–h* illustrate a general overview of one manner in which the apparatus of the present invention may be used to empty a container, such as a flexible bag.
Figures 1D, 1E, 1F:
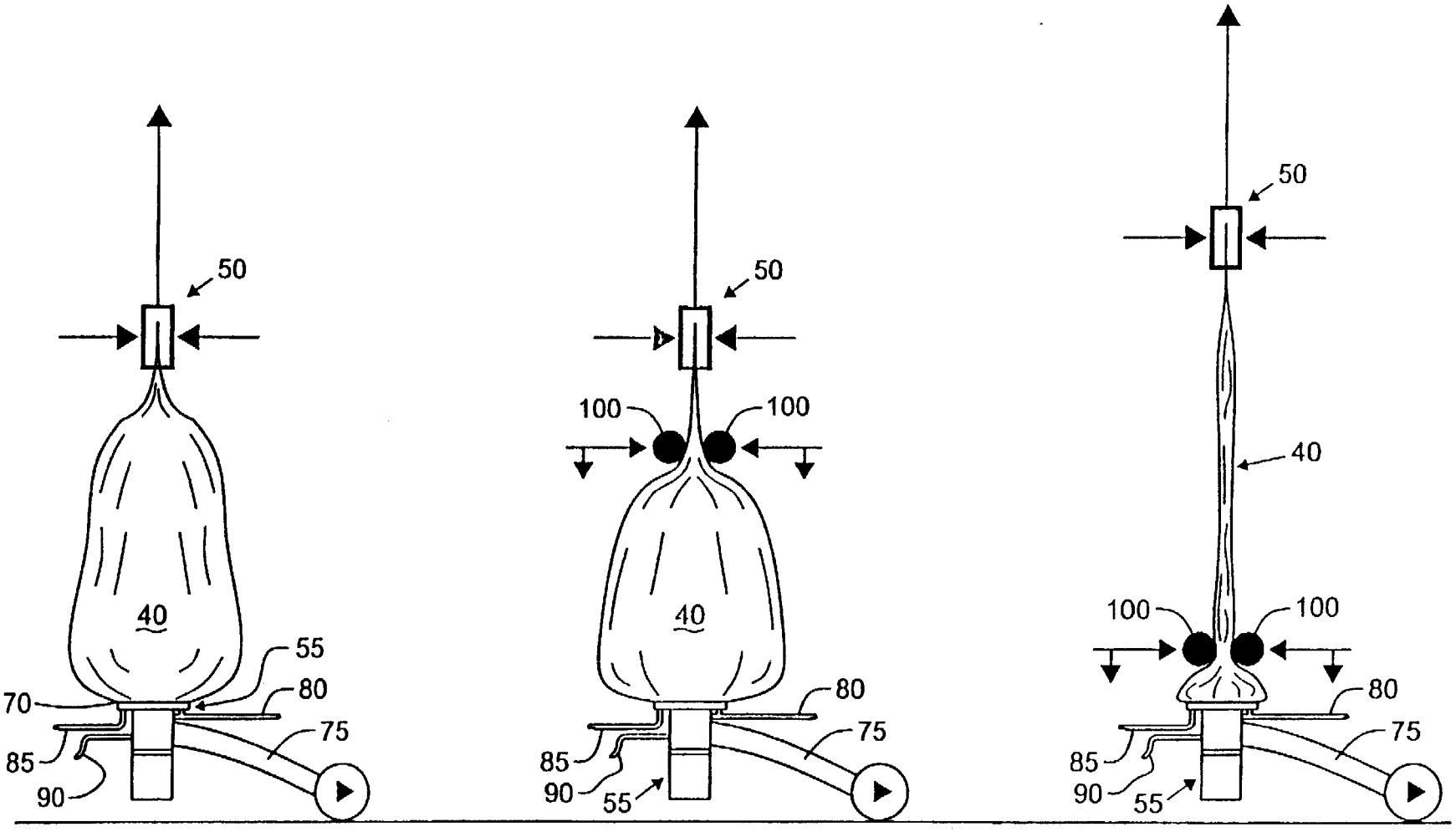
Figure 1H:
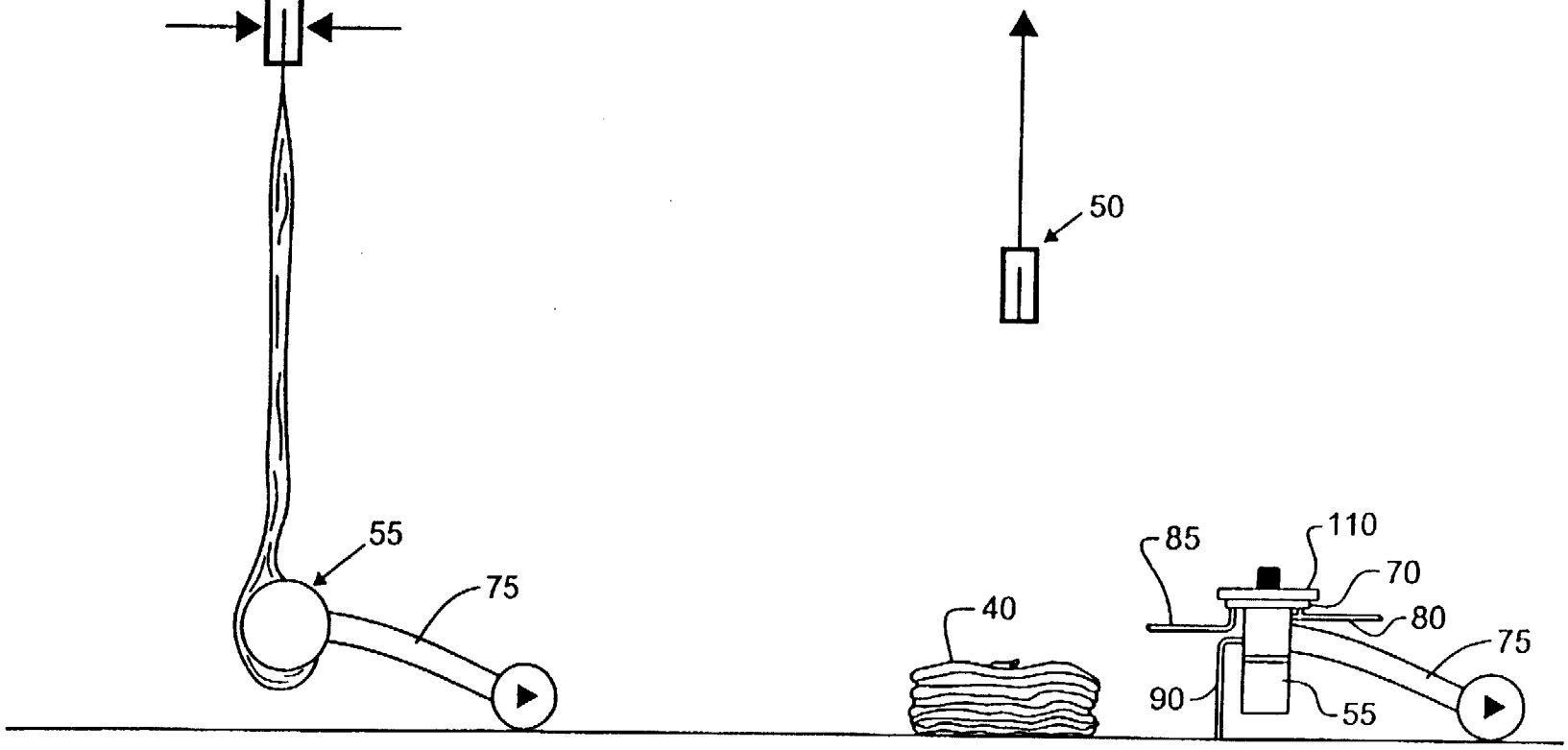
Figure 1G:
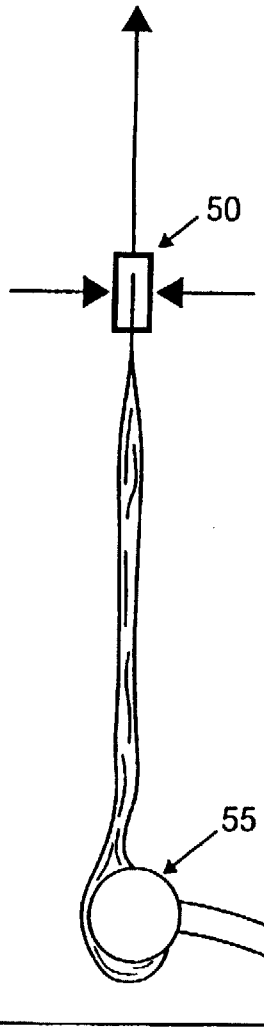

Turning first to FIGS. 1*a* through 1*h*, there is shown a general diagrammatic view of an apparatus and corresponding method for emptying a container 40, such as a flexible bag containing food product, in an aseptic manner. The overall apparatus, shown generally at 45 includes a hoist 50, an aseptic emptying apparatus 55, a vacuum apparatus 60, and a sterilization apparatus 65. The emptying apparatus 55 has at least one internal chamber (not shown in FIGS. 1*a*–1*h*), a container cutting mechanism (not shown in FIGS. 1*a*–1*h*), and a sealing member 70. A first conduit 75 is in fluid communication with a processing machine, packaging machine, intermediate storage tank, or the like, while a second conduit 80 places the apparatus 55 in communication with the sterilization apparatus 65. A third conduit 85 places the sealing member 70 in fluid communication with the vacuum apparatus 60, or similar source of underpressure, while a fourth conduit 91 places the emptying apparatus in fluid communication with a drain or the like.

In operation, the container 40 is grasped by the hoist 50 and is lifted out of the drum 90 in which the container 40 has been shipped. The hoist 50 positions the container 40 above the aseptic emptying apparatus 55 and lowers it to engage the sealing member 70. The sealing member 70, with the assistance of an underpressure generated by the vacuum apparatus 60, creates a seal against the container 40. After creation of the seal, the internal chamber of the emptying apparatus 55 and the portion of the container 40 in engagement with sealing member 70 are sterilized by, for example, providing steam or an active chemical sterilant, from the sterilization apparatus 65. The container 40 is then penetrated and opened by the cutting apparatus to allow food product to flow into the internal chamber of the emptying apparatus 55. Preferably, a mechanism is provided to seal conduit 75 from the internal chamber of the apparatus 55 until after sterilization has taken place. Conduit 75 is typically aseptic and such sealing ensures its aseptic integrity. The seal may then be removed after sterilization to thereby allow the food product to flow through conduit 75. Rollers 100 may be used to facilitate emptying of the container 40 in the illustrated manner. After the container 40 is emptied, the emptying apparatus 55 may be rotated in the manner shown in FIG. 1*h* to remove any residual food product that may otherwise cling to the internal chamber and sealing member 70. A sealing cover 110 may then be placed on the apparatus 55 until the next bag 40 is positioned to be emptied. The sealing cover 110 assists in maintaining sterility of the internal chamber(s) thereby reducing or eliminating the risk of contamination of the until the next bag is positioned for emptying.

Figure 4:
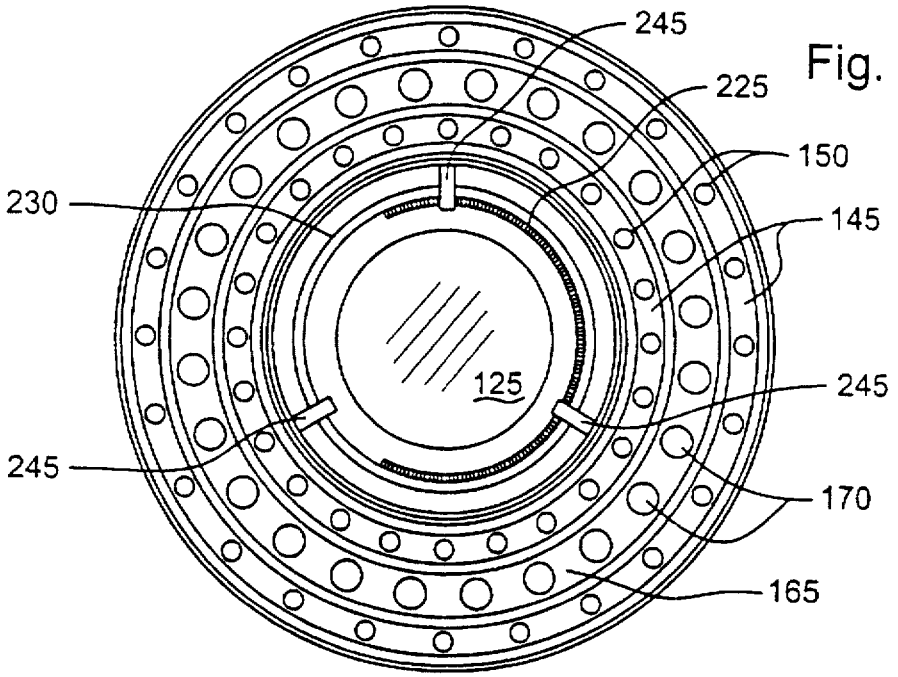
FIG. 4 is a top plan view of the embodiment of FIG. 2.
Figure 2:
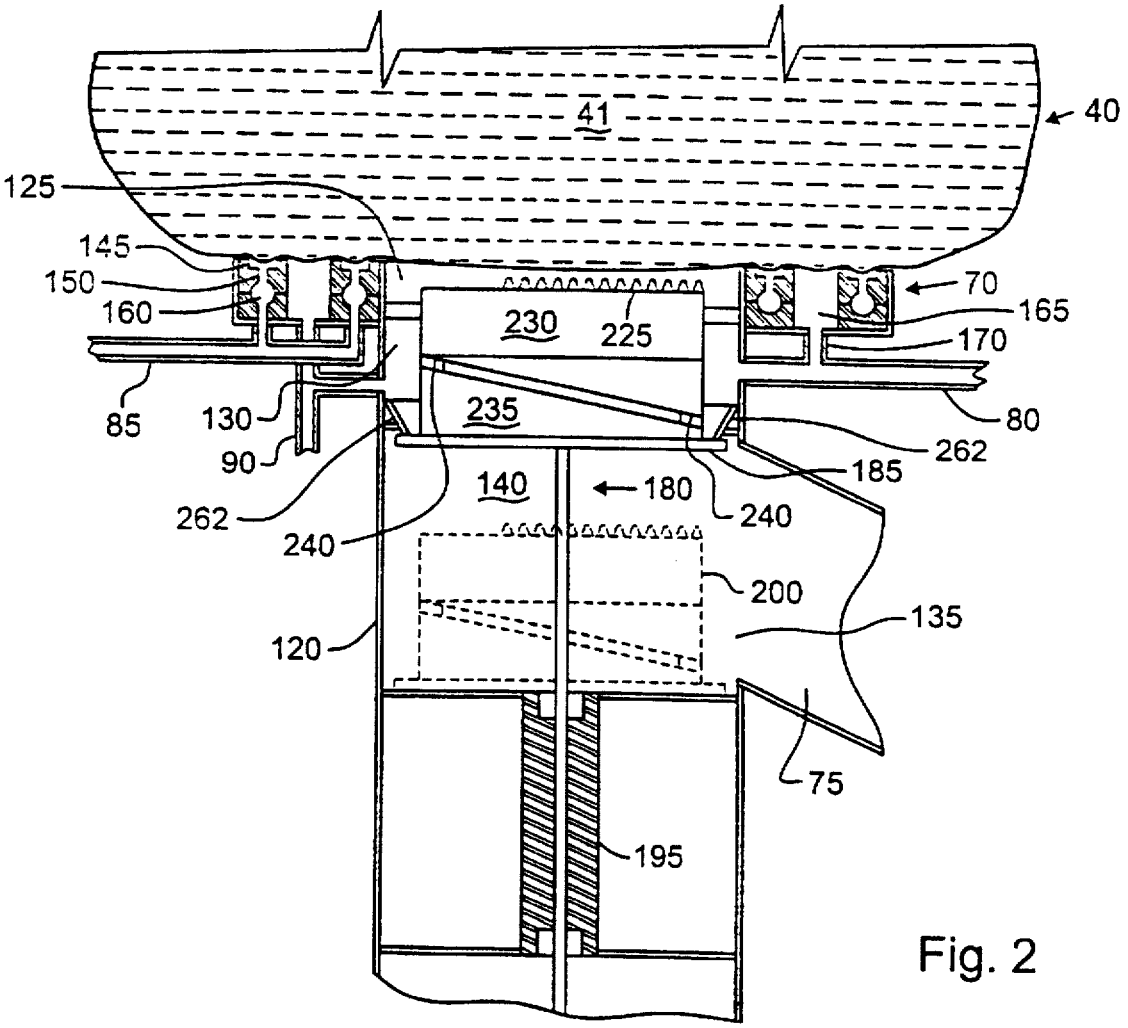
FIG. 2 is a cross-sectional view of one embodiment of the disclosed apparatus with the piston in a first position and with the housing sealed against a bag to be emptied.
Figure 3:
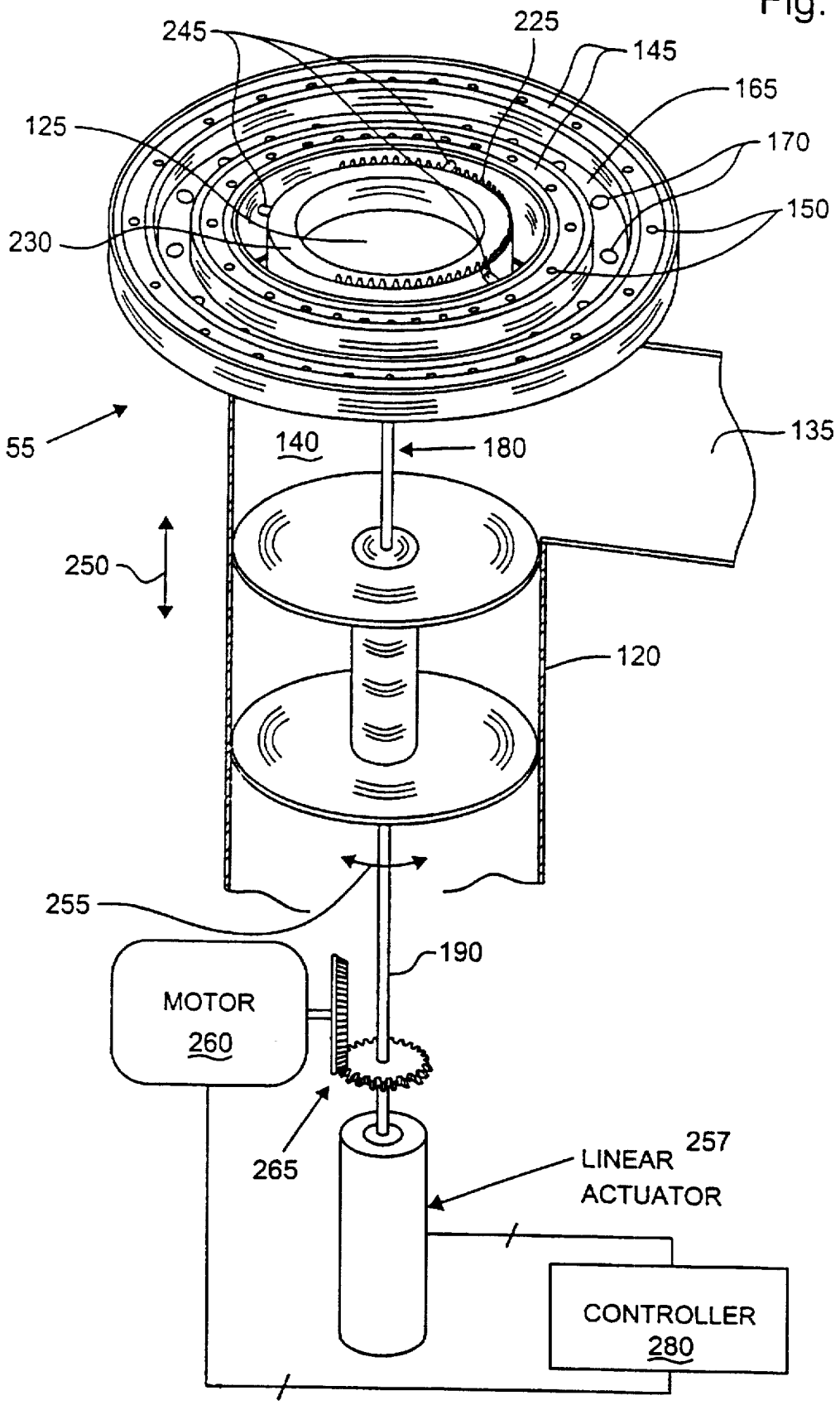
FIG. 3 is a partially diagrammatic perspective view of the embodiment of FIG. 2 with the piston in a first position.

FIGS. 2 and 3 show partially diagrammatic and perspective views of one embodiment of the aseptic emptying apparatus 55. As shown, the emptying apparatus 55 includes a housing 120 having a first aperture 125 that opens to a first internal chamber 130. The housing 120 also includes a second aperture 135 that opens to a second internal chamber 140. The sealing member 70 is disposed proximate the first aperture 125 for sealing with the container 40. As best shown in FIGS. 2 and 4, the sealing member 70 comprises one or more circumferential vacuum channels 145 each having a plurality of vacuum ports 150 formed therein. The vacuum ports 150 are in fluid communication with a manifold 160 that, in turn, is in fluid communication with the vacuum apparatus 60 through conduit 85.

The sealing member 70 may also contain one or more circumferential sterilization barrier channels 165 formed therein. The channel 165 includes at least one sterilization port 170 that is in fluid communication with the sterilization apparatus 65 through conduit 80. Conduit 80 may also serve to place the first internal chamber 130 in fluid communication with the sterilization apparatus 65. The sterilization apparatus 65 may be a source of culinary pressurized steam, a source of a chemical sterilant, such as $H_2O_2$ or the like, or any form of sterilization apparatus.

As is also shown in FIGS. 2 and 4, a piston assembly 180 comprising a piston head 185 and a piston arm 190 is disposed within the housing 120. A guide collar assembly 195 is also disposed in housing 120 and serves to guide and support the piston arm 190. The piston assembly 180 is movable between a first position, illustrated in FIG. 2, and a second position designated in phantom outline at 200 of FIG. 2. While in the first position, the piston head 185 defines and seals the first internal chamber 130 from the second internal chamber 140. In the second position, the piston head 185 is positioned to place the first and second internal chambers 130 and 140 in fluid communication with one another.

A cutting mechanism, shown generally at 220, is also disposed in the housing 120. In the embodiment illustrated in FIGS. 2 and 3, the cutting mechanism comprises a plurality of razor teeth 225 positioned along a majority of the outer circumferential edge of the cam follower 230, such as for example, 240 degrees thereof. A cam 235 is fixed to the piston head 185. The cam follower 230 is locked in engagement with the cam 235 by locking clips 240 and, further, prevented from rotating with respect to the housing 120 by locking pins 245 when the cam 235 and follower 230 are in the position shown in FIG. 2. Locking pins 245 are fixed within the housing 120 and engage, for example, locking pin channels disposed in the outer sidewalls of the cam follower 230. The locking pins 245 engage the end of the locking pin channels to prevent the cam follower 230 from being pushed out of the first aperture 125.

Other embodiments of cutting mechanisms may likewise be employed. For example, a cutting member may be directly affixed to the piston head 185. In such instances, the cutting member must be of sufficient length to extend through the first internal chamber 130 into contact with the bottom of the container 40 when the piston head is moved to its upper position. Alternatively, the cutting mechanism may be fixed within the first internal chamber 130 and actuated by, for example, a linear actuator within the chamber 130 or by an electromagnetic actuator exterior to the chamber 130.

With reference to FIGS. 2 and 3, the piston arm 190 may be moved linearly along the direction indicated by arrow 250 and, further, may be rotated in the direction indicated by arrow 255. To this end, the piston arm 190 is associated with a linear actuator 257 for moving the piston 180 between its first and second positions. A circumferential stop 262 is fixed within the housing 120 to stop the piston head 185 from moving beyond its first position while the end of guide collar assembly 195 prevents linear movement beyond the second position. Rotation of the piston 280 may be facilitated by connecting a bi-directional motor 260, for example, a servomotor, to the piston arm 190 through a gearing mechanism 265. Both the motor 260 and linear actuator 257 may be controlled by a controller 280 that, for example, may be a software programmable controller (such as disclosed in U.S. patent application Ser. No. 08/315,414 (which is incorporated by reference)). Optionally, a tip and drive mechanism may be associated with the housing 120 to facilitate tipping the housing 120 and thereby emptying the first internal chamber 130.

In operation, the piston head 185 is driven to the first position shown in FIG. 2. While in this position, the cam follower 230 is locked from rotation by the locking pins 245. The container 40 is then placed over the aperture 125 and sealing member 70. Vacuum apparatus 60 is activated to generate an underpressure to the vacuum channels 145 thereby urging the container 40 against the sealing member 70 to effect a seal of the first interior chamber 130. The sterilization apparatus 65 is then activated to sterilize all contact surfaces within the first internal chamber 130 and, further, within the sterilization channel 165. The sterilization channel 165 assists in maintaining the chamber 130 sterile by providing a sterile buffer zone between the internal chamber 130 and the outside environment. Excess and spent sterilant may ultimately be removed through drain conduit 90. It will be understood that any suitable cutting mechanism, that does not subject the first internal chamber 130 to contamination is acceptable. By way of example, a cutting blade that is magnetically actuated from outside of the housing would be acceptable.

Figure 5:
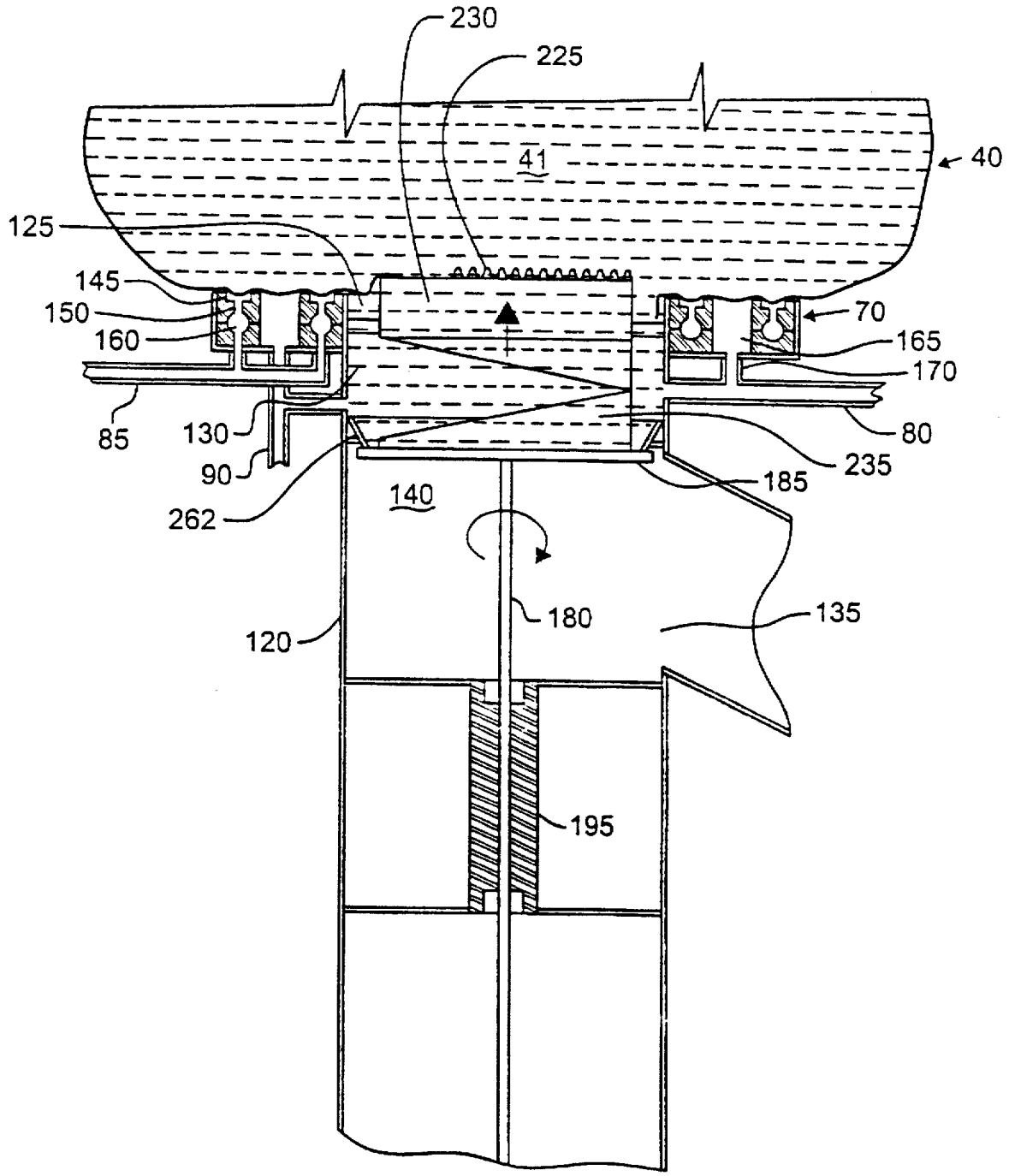
FIG. 5 is a cross-sectional view of the embodiment of FIG. 2 with the piston having been rotated so as to extend the cutting mechanism associated with the cam follower and the bag having been cut open and the contents emptied into the first internal chamber.
Figure 6:
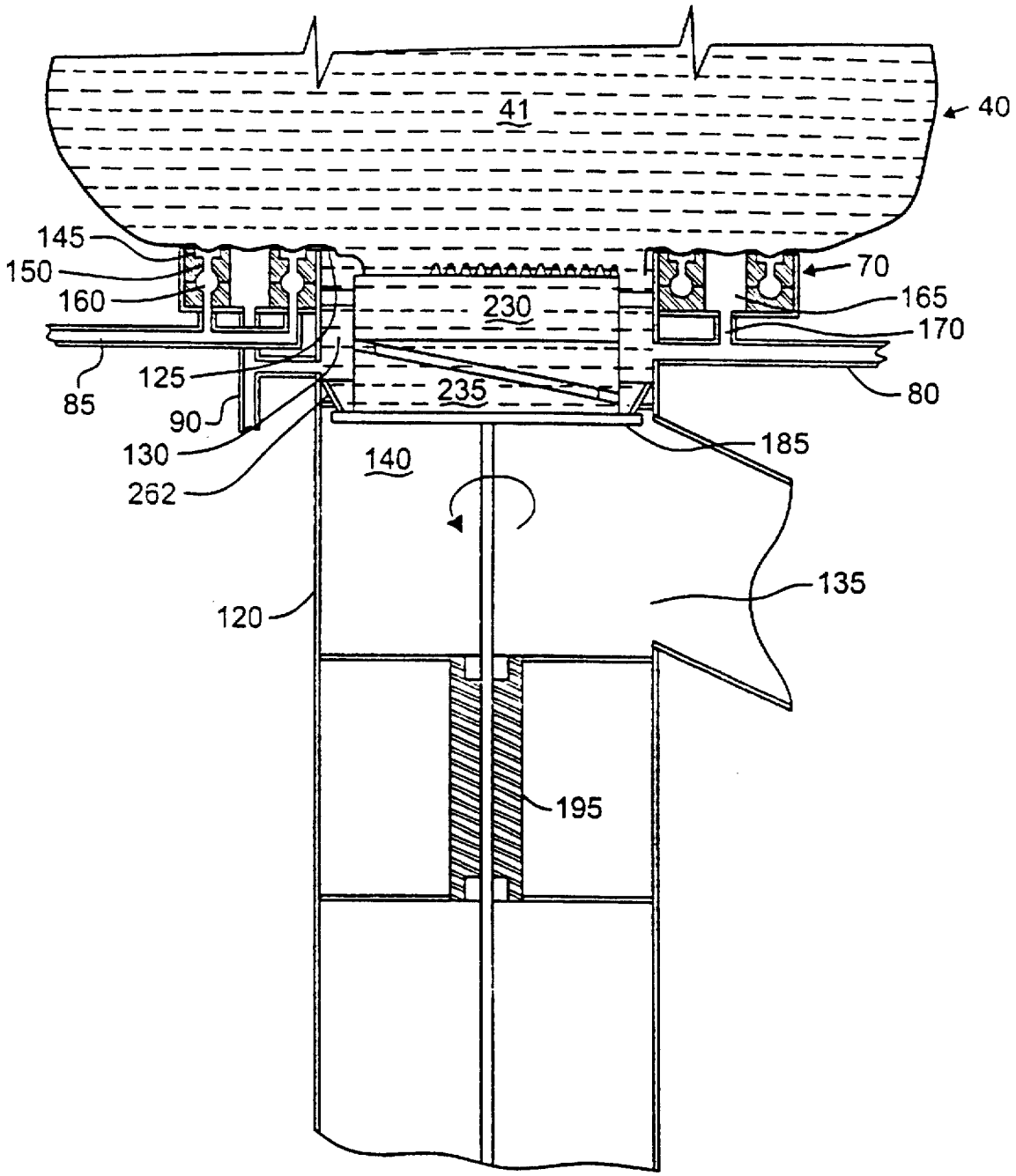
FIG. 6 is a cross-sectional view of the embodiment of FIG. 2 with the piston having been rotated back so as to return the cam follower to its original position.
Figure 7A:
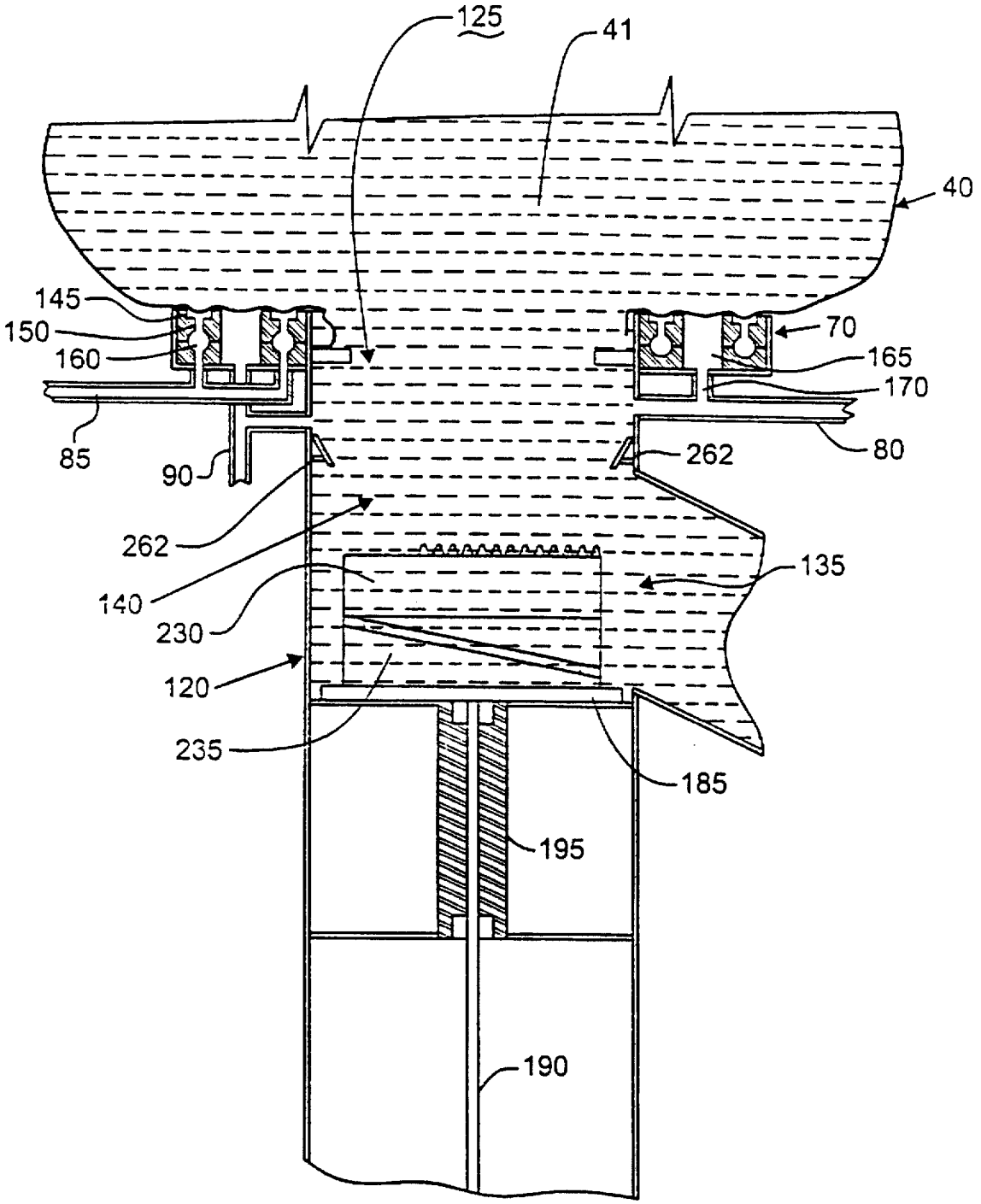
FIG. 7A is a cross-sectional view of the embodiment of FIG. 2 with the piston in a second position so as to allow the first and second internal chambers to be in fluid communication.

After a predetermined period of time has elapsed during which sterilization is accomplished, the piston 180 is rotated to cause the locking clips 240 to disengage from one another, thereby leaving the follower 230 fixed from rotational movement while allowing the cam 235 to rotate. As the cam 235 rotates against the follower 230, the follower 230 is driven upward in the direction indicated by arrow 290. As illustrated in FIG. 5, the razor teeth 225 cut into the bottom of the container 40 thereby allowing the container contents 41 to flow into the now sterilized first internal chamber 130. As shown in FIG. 6, after the container 40 has been opened, the piston 180 is rotated back to the position shown in FIG. 2 to cause the locking clips 240 to re-engage. As shown in FIG. 7A, the piston 180, along with the cam 235 and the cam follower 230 (now locked together by locking clips 240), is moved to the second position to allow the container contents 41 to flow into the already aseptic second internal chamber 140. The content 41 is allowed to proceed through the first aperture 125, the second aperture 135, and conduit 75 to the desired destination, by gravity or by way of a pump (not shown), without exposure to a non-aseptic or non-hygienic environment. As is clear from the foregoing description, the container 40 has been opened and container content 41 has been moved to the desired destination without contamination thereby eliminating the need for further sterilization of the content 41.

Figure 7B:
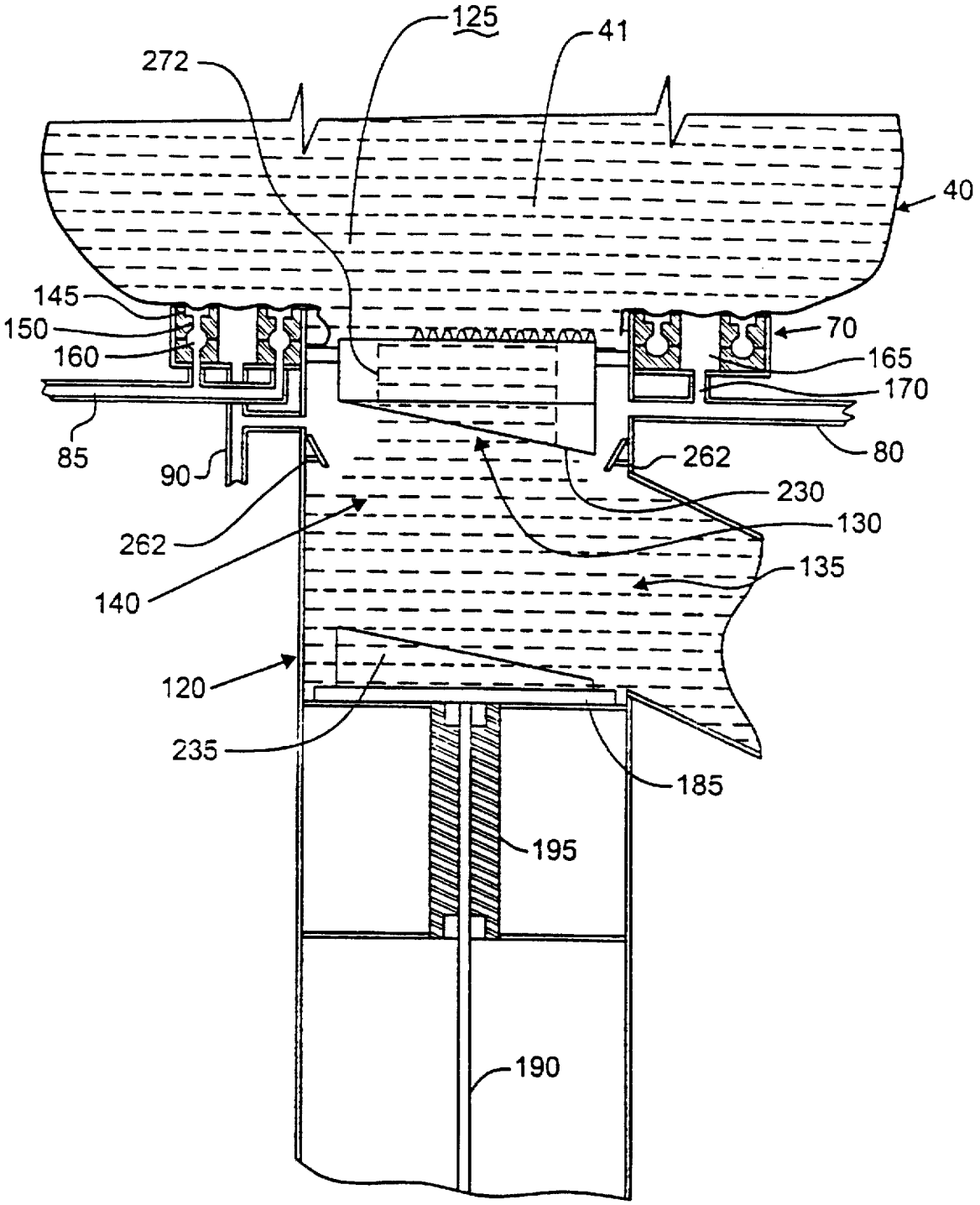
FIG. 7B is a cross-sectional view of a modification of the embodiment of FIG. 2 with the piston in a second position so as to allow the first and second internal chambers to be in fluid communication.

FIG. 7B illustrates a modification of the manner in which the cam 235 engages the follower 230 to urge the cutting mechanism against the bottom of the container 40. In this embodiment, the cam 235 and follower 230 are not necessarily interlocked by locking clips 240. Therefore, the cam 235 and follower 230 may be separated from one another in the illustrated manner, whereby the follower 230 and corresponding cutting mechanism are locked for limited vertical movement within the first internal chamber 130. In such instances, the follower 230 is provided with a centrally disposed aperture 272 through which the product 41 is allowed to flow.

Figure 8:
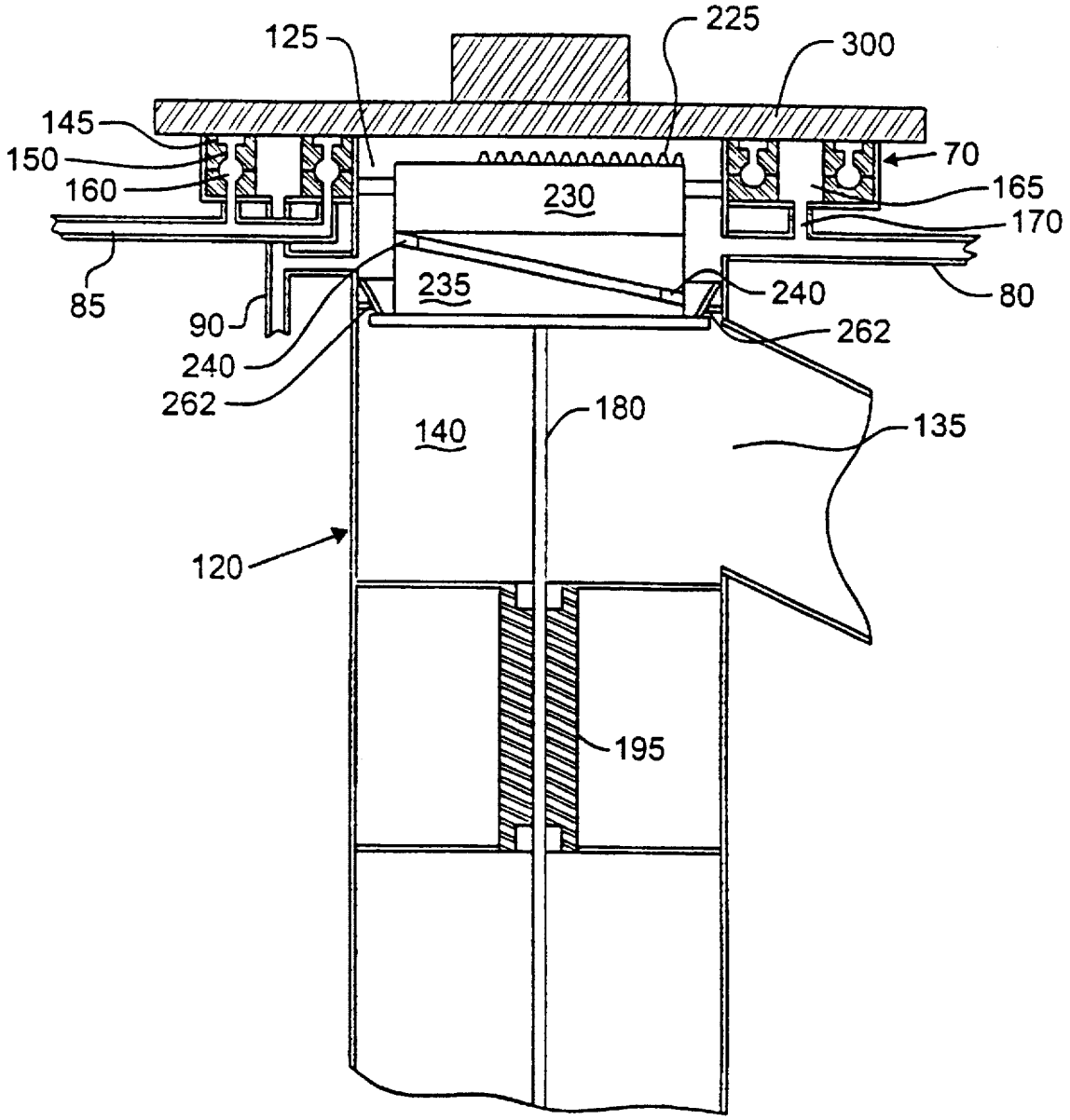
FIG. 8 is a cross-sectional view of the embodiment of FIG. 2 after the piston is again in its first position and after the remaining residue has been flushed from the first internal chamber and a sealing cover has been placed over the first aperture of the housing.

Turning now to FIG. 8, after the contents 41 have been largely emptied from the container 40, the piston 180 is moved from its second position to its first position, thereby forming a seal between the piston head 185 and the circumferential stop 262. The remaining contents 41 contained in the second internal chamber 140 may then, optionally, be pumped through the second aperture 135. At this time, the vacuum apparatus 60 is operated to terminate the underpressure condition so as to allow the sealing member 70 to release the container 40. The sterilization apparatus 65 is then activated to flush the residual contents 41 out of the first internal chamber 130. Optionally, flushing nozzles, which are in fluid communication with a source of water or other appropriate flushing fluid, may be disposed in the first internal chamber 130, to flush the remaining contents 41 from the first internal chamber 130. In addition, the housing 120 may be tilted, either manually or by a tilt and drive mechanism (not shown), to facilitate the flushing and emptying of the first internal chamber 130.

As shown in FIG. 8, a removable cover 300, that is capable of forming a flush seal with the sealing member 70 may be utilized. With the cover 300 in place, the vacuum apparatus 60 and the sterilization apparatus 65 are again activated to further clean the first internal chamber 130 in preparation for the next container to the emptied. The cover 300 assists in maintaining sterility of the first internal chamber 130 internal chamber thereby reducing or eliminating the risk of contamination of the second internal chamber 140 until the next container is positioned for emptying.

In accordance with another embodiment of the apparatus, and as shown in FIGS. 9 and 10, a ring member 305 may be disposed on the bottom of the container 40. The ring member 305 comprises a relatively flat portion 310 and a protruding portion 312 to facilitate sealing against the sealing member 70. For example, the protruding portion 312 may have a diameter corresponding to one of the vacuum channels 145 or to the sterilization channel 165. The ring member 305 may be attached to the container 40 in any suitable manner, such as by heat sealing, sonic welding, adhesive bonding, or the like.

Figure 11:
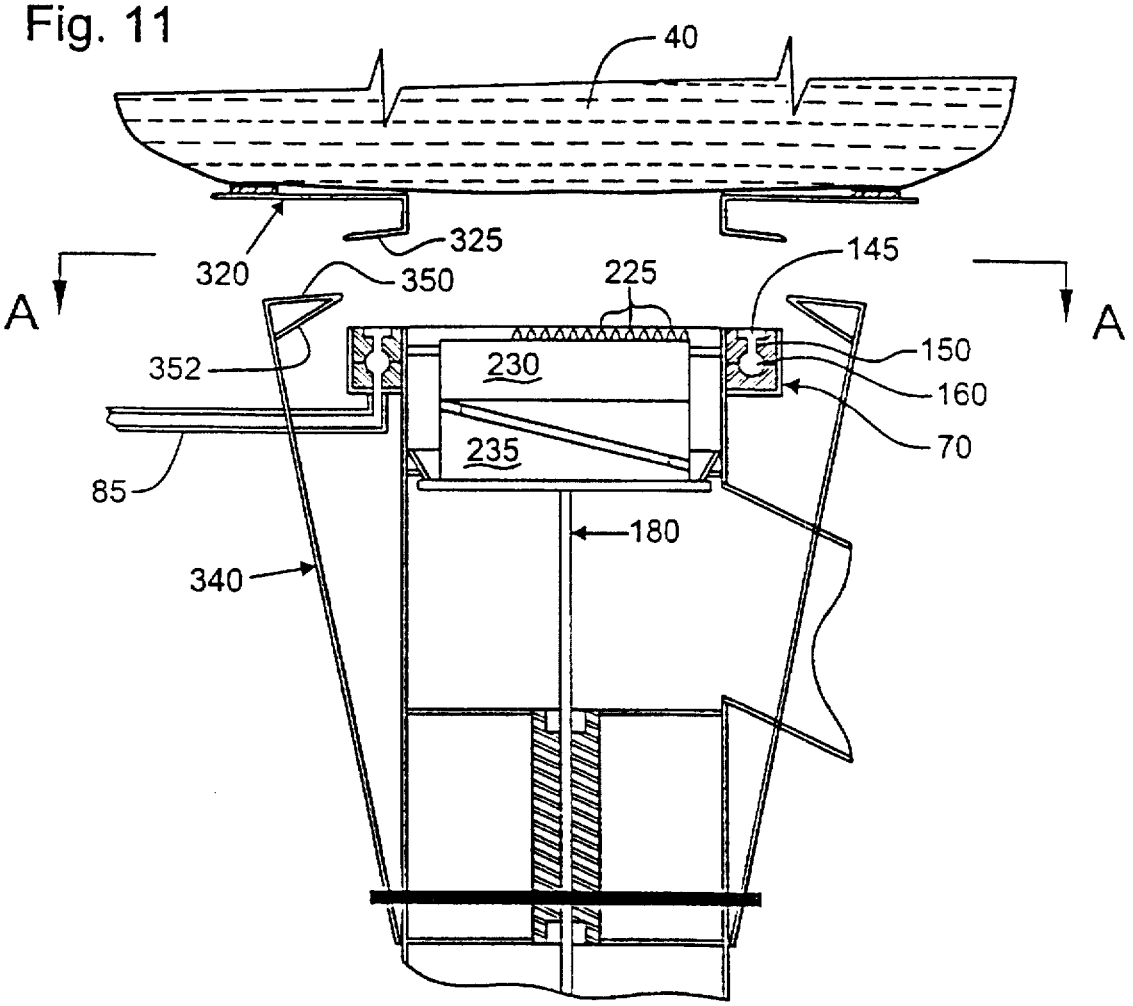
FIGS. 11–13 show another embodiment of the apparatus in which sealing arms are disposed on the housing for grasping a flange disposed on the flexible bag.
Figure 11A:
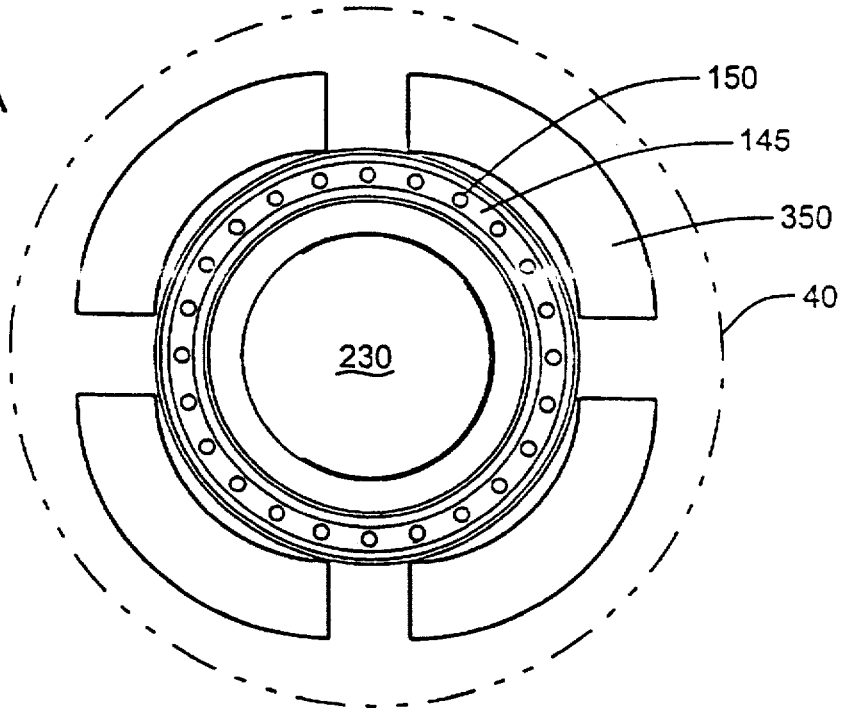
Figure 12:
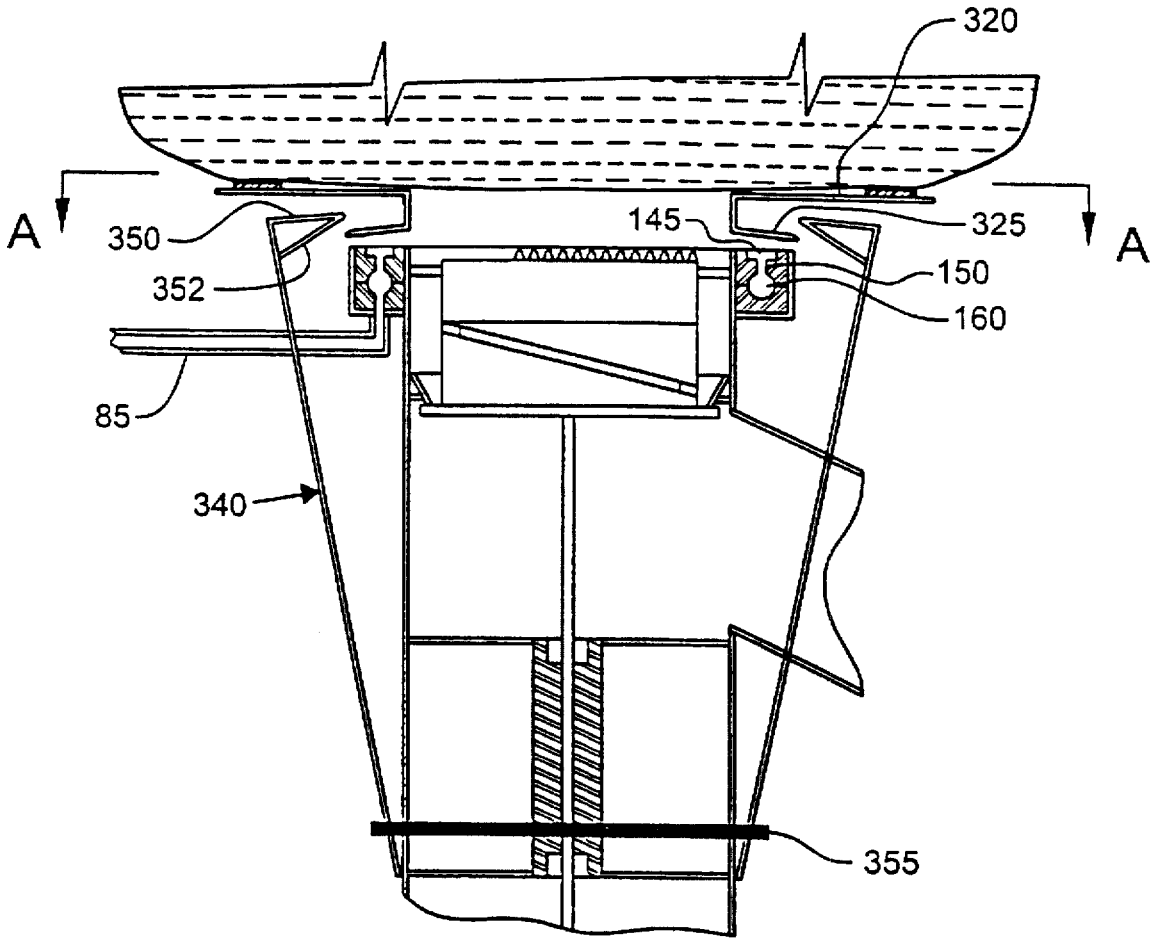
Figure 12A:
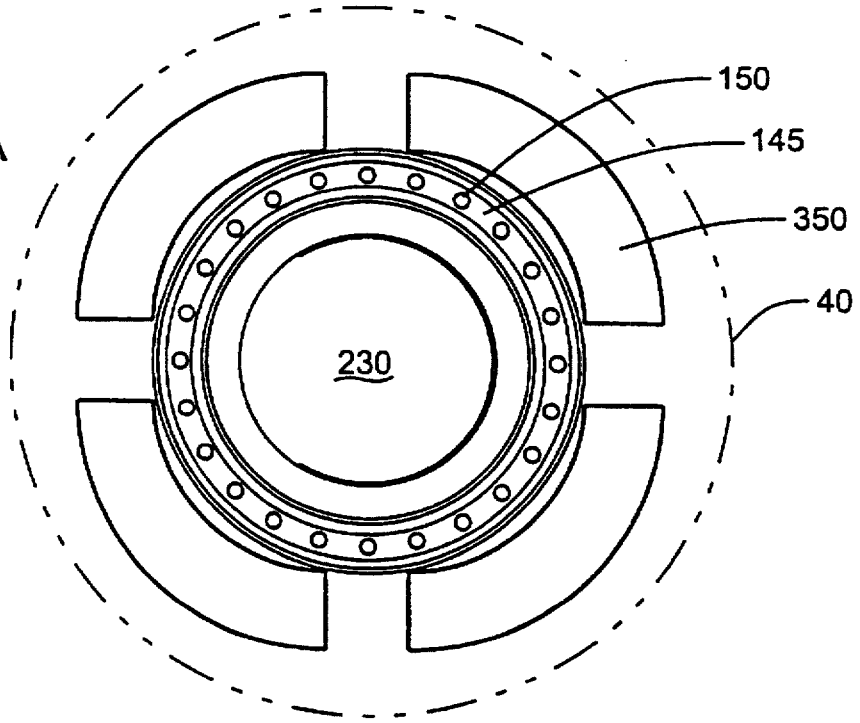
Figure 13:
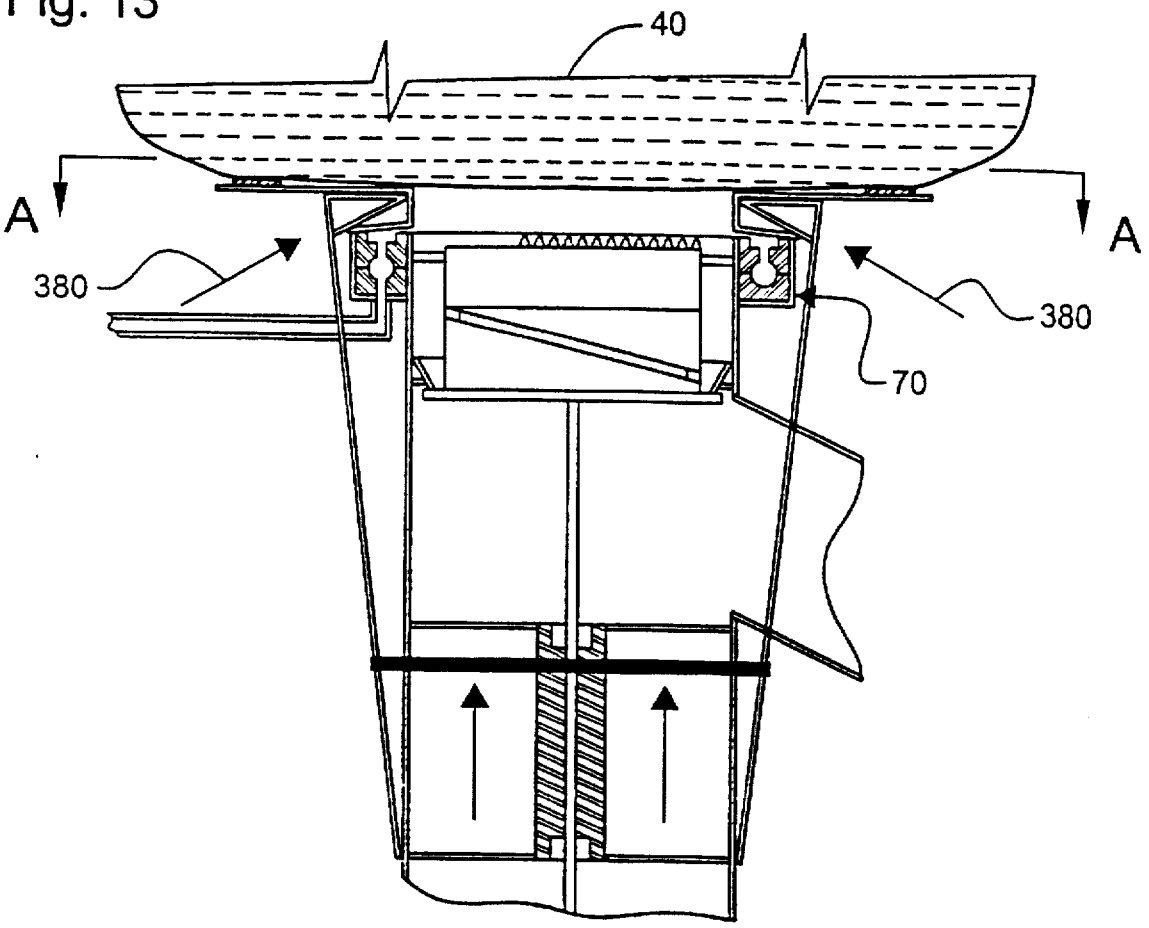
Figure 13A:
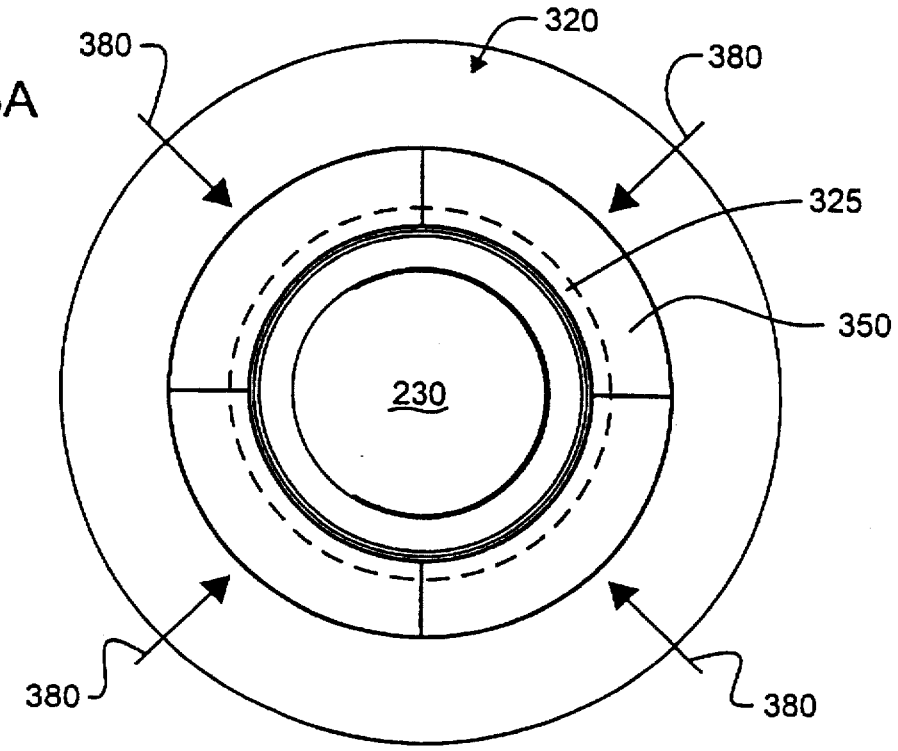

FIGS. 11–13 illustrate another manner in which the container 40 may be secured with the sealing member 70. As illustrated, a ring member 320 is provided on the bottom of container 40. The ring member 320 includes an inwardly turned flange 325. A plurality of grasping arms 340 are disposed, for example, about the periphery of the housing 120. Each grasping arm 340 has a locking finger 350 having a spring arm 352. The locking finger 350 and associated spring arm 352 are dimensioned to interlock with the flange 325. An arm closure member 355 is disposed about the grasping arms 340 and is slideable about the housing 120 and the grasping arms 340 from a first position, illustrated in FIG. 11, to a second position, illustrated in FIG. 13. The arm closure member 335, may be moved between the first and second positions manually or, for example, by one or more linear actuators.

Operation of the further embodiment is apparent from the states of the apparatus shown in FIG. 11–13. First, the container 40 is disposed above the sealing member 70 and is aligned so that the ring 320 overlies the sealing member 70 in the illustrated manner. The container 40 is then lowered to the position shown in FIG. 12, at which point the locking fingers 350 are positioned to engage the flange 325. The arm closure member 355 is then moved from its first position to the second position illustrated in FIG. 13 to thereby cause a force in the direction of arrows 380 which urges the locking fingers 350 to engage the flange 325 to assist in securing the container 40 against the sealing member 70. The vacuum apparatus 60 is operated to generate an underpressure which further assists in securing the container 40 to the sealing member 70. The emptying process may then proceed in the manner described above.

Although the present invention has been described with reference to a specific embodiment, those of skill in the art will recognize that changes may be made thereto without departing from the scope and spirit of the invention as set forth in the appended claims.

I claim as my invention:

1. A device for emptying a container in a generally hygienic manner, the device comprising:

a housing having a first aperture that opens to a first internal chamber and having a second aperture that opens to a second internal chamber, the second internal chamber being generally hygienic;

a sealing member disposed about the first aperture for sealing the container to be emptied over the first aperture;

sterilizing means for rendering the first internal chamber generally hygienic when the container has been sealed over the first aperture;

chamber separating means for selectively providing fluid communication between the first and second internal chambers, the chamber separating means being operable to seal the first internal chamber from the second internal chamber when the first internal chamber is exposed to a non-hygienic environment, and operable to allow fluid communication between the first and second internal chambers after the first internal chamber has been rendered generally hygienic by the sterilizing means, the chamber separating means comprising a piston moveable between a first position in which it defines and seals the first internal chamber and a second position in which the first and second internal chambers are in fluid communication; and a cutting member operable to cut the container in the area of the first aperture to thereby allow the container to be emptied into the first internal chamber.

2. The container emptying device of claim 1 wherein the piston is rotatable between a first angular position and a second angular position and the cutting member comprises a cam surface in fixed relation with the piston and a cam follower, the cam follower having a cutting surface thereon, and wherein the cam surface urges the cam follower against the bag to be emptied upon rotation of the piston.

3. The container emptying device of claim 2 wherein the cutting surface comprises a plurality of teeth.

4. The container emptying device of claim 1 comprising in addition a drive mechanism for moving the piston from the first position to the second position.

5. The container emptying device of claim 1 wherein the sealing member comprises a sealing surface for sealing against the container, the sealing surface having a plurality of vacuum ports disposed therethrough.

6. The container emptying device of claim 5 wherein the sealing member further comprises a sterilization chamber.

7. The container emptying device of claim 6 wherein the sterilization chamber is disposed in the sealing surface.

8. The container emptying device of claim 1 and further comprising an interlocking mechanism comprising a first interlocking member disposed on the container and a second interlocking member disposed about the housing, the interlocking mechanism providing a mechanical interlock to facilitate sealing of the container over the first aperture.

9. The container emptying device of claim 8 wherein the first interlocking member comprises a securement having a flange.

10. The container emptying device of claim 9 wherein the second interlocking member comprises at least one arm having a locking finger, the arm being movable between a first position at which it is generally disengaged from the flange and a second position at which it engages the flange to urge the container against the sealing member.

11. The container emptying device of claim 1 wherein the container holds an aseptic product and wherein the second internal chamber is aseptic and wherein the sterilizing means renders the first internal chamber aseptic.

12. The container emptying device of claim 11 wherein the container is a flexible bag.

13. The container emptying device of claim 1 wherein the container is a flexible bag.

14. The container emptying device of claim 8 wherein the container is a flexible bag.

15. A device for emptying a container in a generally hygienic manner, the container being formed as a flexible bag having a generally flexible polymer wall, the device comprising:

a housing having a first aperture that opens to a first internal chamber and having a second aperture that opens to a second internal chamber, the second internal chamber being generally hygienic;

a sealing member disposed about the first aperture for sealing the generally flexible polymer wall of the container over the first aperture;

sterilizing means for rendering the first internal chamber and the flexible wall material over the first aperture generally hygienic when the container has been sealed over the first aperture;

chamber separating means for selectively providing fluid communication between the first and second internal chambers, the chamber separating means being operable to seal the first internal chamber from the second internal chamber when the first internal chamber is exposed to a non-hygienic environment, and operable to allow fluid communication between the first and second internal chambers after the first internal chamber has been rendered generally hygienic by the sterilizing means; and a cutting member including a cutting edge for engaging and cutting the flexible wall of the container in the area of the first aperture to thereby allow the container to be emptied into the first internal chamber.

16. The container emptying device of claim 15 wherein the chamber separating means comprises a piston moveable between a first position in which it defines and seals the first internal chamber and a second position in which the first and second internal chambers are in fluid communication.

17. The container emptying device of claim 16 wherein the piston is rotatable between a first angular position and a second angular position and the cutting member comprises a cam surface in fixed relation with the piston and a cam follower, the cam follower having the cutting edge thereon, and wherein the cam surface urges the cam follower against the bag to be emptied upon rotation of the piston.

18. The container emptying device of claim 17 wherein the cutting edge comprises a plurality of teeth.

19. The container emptying device of claim 16 comprising in addition a drive mechanism for moving the piston from the first position to the second position.

20. The container emptying device of claim 15 wherein the sealing member comprises a sealing surface for sealing against the container, the sealing surface having a plurality of vacuum ports disposed therethrough.

21. The container emptying device of claim 20 wherein the sealing member further comprises a sterilization chamber.

22. The container emptying device of claim 21 wherein the sterilization chamber is disposed in the sealing surface.

23. A device for emptying a container in a generally hygienic manner, the device comprising:

a housing having a first aperture that opens to a first internal chamber and having a second aperture that opens to a second internal chamber, the second internal chamber being generally hygienic;

a sealing member disposed about the first aperture for sealing the container to be emptied over the first aperture, the sealing member comprising a sealing surface for sealing against the container, the sealing surface having a plurality of vacuum ports disposed therethrough;

sterilizing means for rendering the first internal chamber generally hygienic when the container has been sealed over the first aperture;

chamber separating means for selectively providing fluid communication between the first and second internal chambers, the chamber separating means being operable to seal the first internal chamber from the second internal chamber when the first internal chamber is exposed to a non-hygienic environment, and operable to allow fluid communication between the first and second internal chambers after the first internal chamber has been rendered generally hygienic by the sterilizing means; and a cutting member operable to cut the container in the area of the first aperture to thereby allow the container to be emptied into the first internal chamber.

24. The container emptying device of claim 23 wherein the sealing member further comprises a sterilization chamber.

25. The container emptying device of claim 24 wherein the sterilization chamber is disposed in the sealing surface.

* * * * *